US007083390B2

(12) United States Patent
Wang

(10) Patent No.: US 7,083,390 B2
(45) Date of Patent: Aug. 1, 2006

(54) FAN WITH ENHANCED OPERATIONAL VERSATILITY

(76) Inventor: Chi-Hsiang Wang, 12F-6, No.16 Jian Ba Rd., Chung Ho, Taipei Hsieng (TW) 235

( * ) Notice: Subject to any disclaimer, the term of this patent is extended or adjusted under 35 U.S.C. 154(b) by 87 days.

(21) Appl. No.: 10/885,385

(22) Filed: Jul. 7, 2004

(65) Prior Publication Data

US 2006/0008353 A1 Jan. 12, 2006

(51) Int. Cl.
*F04D 29/60* (2006.01)

(52) U.S. Cl. ..... 416/244 R; 416/246; 415/213.1; 417/238

(58) Field of Classification Search ..... 416/247 R, 416/244 R, 246, 82, 79, 149, 148, 157 A, 416/155, 204 R; 415/213.1, 126, 53.1, 214.1, 415/53.2, 121.3; 417/236, 238, 361
See application file for complete search history.

(56) References Cited

U.S. PATENT DOCUMENTS 4,239,459 A * 12/1980 Felter ..... 415/126
2004/0120816 A1* 6/2004 Shapiro ..... 415/213.1

* cited by examiner

*Primary Examiner*—Edward K. Look
*Assistant Examiner*—Richard A. Edgar
(74) *Attorney, Agent, or Firm*—Karry W. Wang, Esq.; Law Offices of K.W. Wang

(57) ABSTRACT

An electric fan with more than one operational configuration is disclosed, comprising a fan unit, a first support element and a second support element. In one operational configuration, the fan unit rests on top of the first support element and generates a horizontally oscillating airflow. In another configuration, the fan unit rests on top of the second support element and generates a vertically oscillating airflow.

9 Claims, 9 Drawing Sheets

FAN WITH ENHANCED OPERATIONAL VERSATILITY

FIELD OF THE INVENTION

The present invention relates generally to a fan assembly, and more particularly to an electric fan with more than one operational configuration.

BACKGROUND OF THE INVENTION

A great variety of consumer fans are known in the industry. Fans of various operational capabilities have been configured for uses in different conditions and locations. For example, some fans have speed or height adjustability, or noise reduction features. Certain fans are configured as floor fans intended to circulate air in a good-sized area, such as a living room. Others are manufactured as desk fans intended for personal use. The present invention provides a method for enhancing the operational versatility of a fan and a fan having such operational versatility.

SUMMARY OF THE INVENTION

One embodiment in accordance with the present invention provides a fan assembly with two operational configurations. In one configuration, the fan body is attached to and rests on top of a support member. In another configuration, the fan body is tilted approximately 90 degrees, and operates on top of a second support member.

Preferably, the fan body comprises an elongated spinning drum having a plurality of fan blades encased in a substantially cylindrical fan housing. The fan housing includes a substantially tubular portion that is rotatable and oscillatable during operation. In the first or upright configuration, the fan generates a transversely oscillating airflow. In the second or horizontal configuration, the fan generates a vertically oscillating airflow.

In addition, the present invention discloses a method for enhancing the operational versatility of a fan. Two support members attachable to a fan are provided. One support member is used to support the fan in a first or upright position. Another support member is used to support the fan in a second or horizontal position.

Another illustrative embodiment of the present invention provides a fan assembly comprising an elongated spinning drum having a plurality of fan blades encased in a substantially cylindrical fan housing, which includes a substantially tubular portion that is rotatable. The tubular portion includes at least one grille member with varied thickness in a circumferential direction about the fan drum. Preferably, the thickness of the grille member decreases in the direction opposite to the rotation of the fan drum, creating a tapered portion for the grille member.

BRIEF DESCRIPTION OF THE DRAWINGS

The foregoing and other objects, aspects and advantages will be better understood from the following description of the embodiments in accordance with the present invention with reference to the accompanying drawings, in which like numerals reference like elements, and wherein.

DETAILED DESCRIPTION OF THE INVENTION

Figure 1:
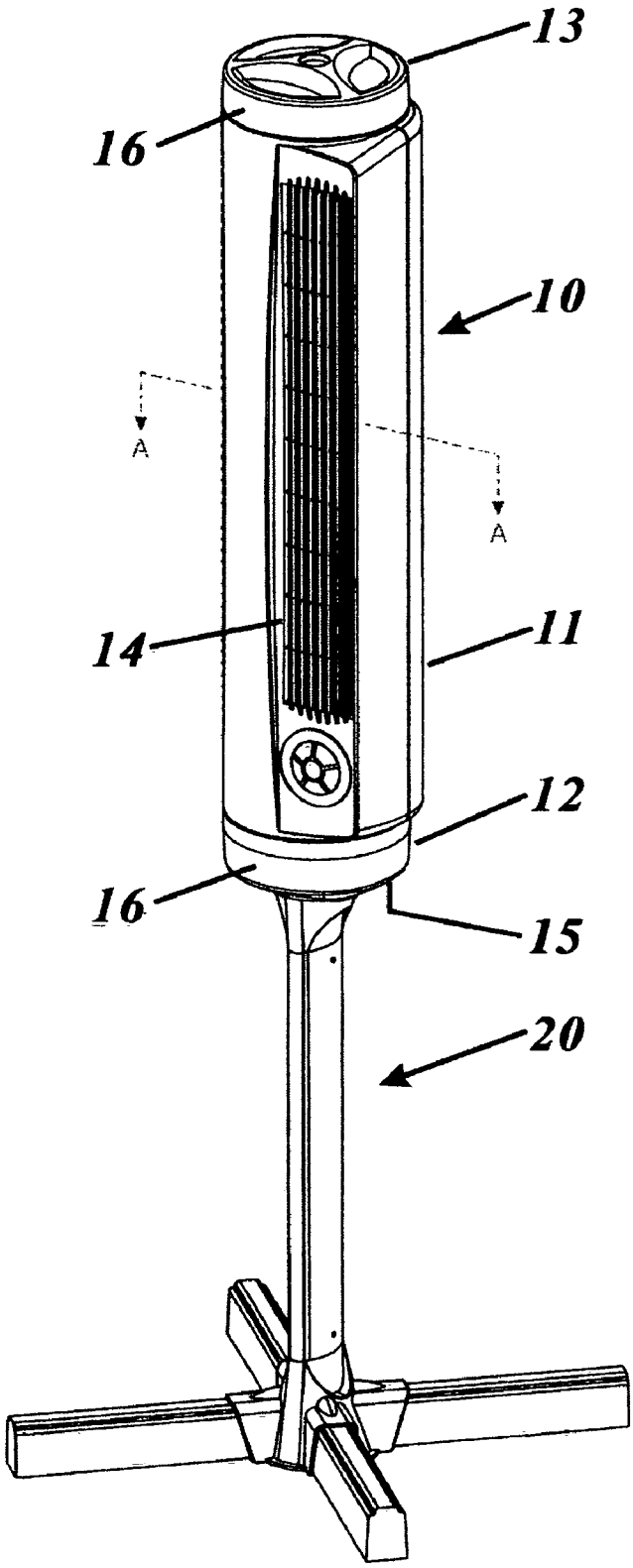
FIG. 1 is a top, front perspective view of a fan assembly in a first operational configuration in accordance with the present invention.

Referring to FIGS. 1–4, an illustrative embodiment of a fan assembly in accordance with the present invention includes a fan body 10, a first support member 20, and a second support member 30.

The fan body 10 comprises a fan (not shown), preferably an elongated spinning drum having a plurality of fan blades, situated inside a substantially cylindrical fan housing, which includes a substantially tubular portion 11, a first end cap member 12, a second end cap member 13, and at least one ventilation opening 14, preferably a grille. The substantially tubular portion 11 is preferably rotatable with respect to the end cap members 12 and 13. The end cap members 12 and 13 define a first surface 15 and a second surface 16 substantially perpendicular to the first surface 15.

Preferably, the end cap member 12 includes a first receiving member 17 on the first surface 15. Similarly, the end cap members 12 and 13 each includes a second receiving member 18 on the second surface 16. The receiving members 17 and 18 are present to enable the first and second support members 20 and 30 to be attached to the fan body 10, respectively, which is described in further detail below. As such, the receiving members 17 and 18 may take any suitable form, including a socket, a clip, a clamp, and any other connecting, coupling or locking mechanisms. Preferably, however, the first receiving member 17 is in the form of a socket and the second receiving member 18 includes at least one clip.

Figure 2:
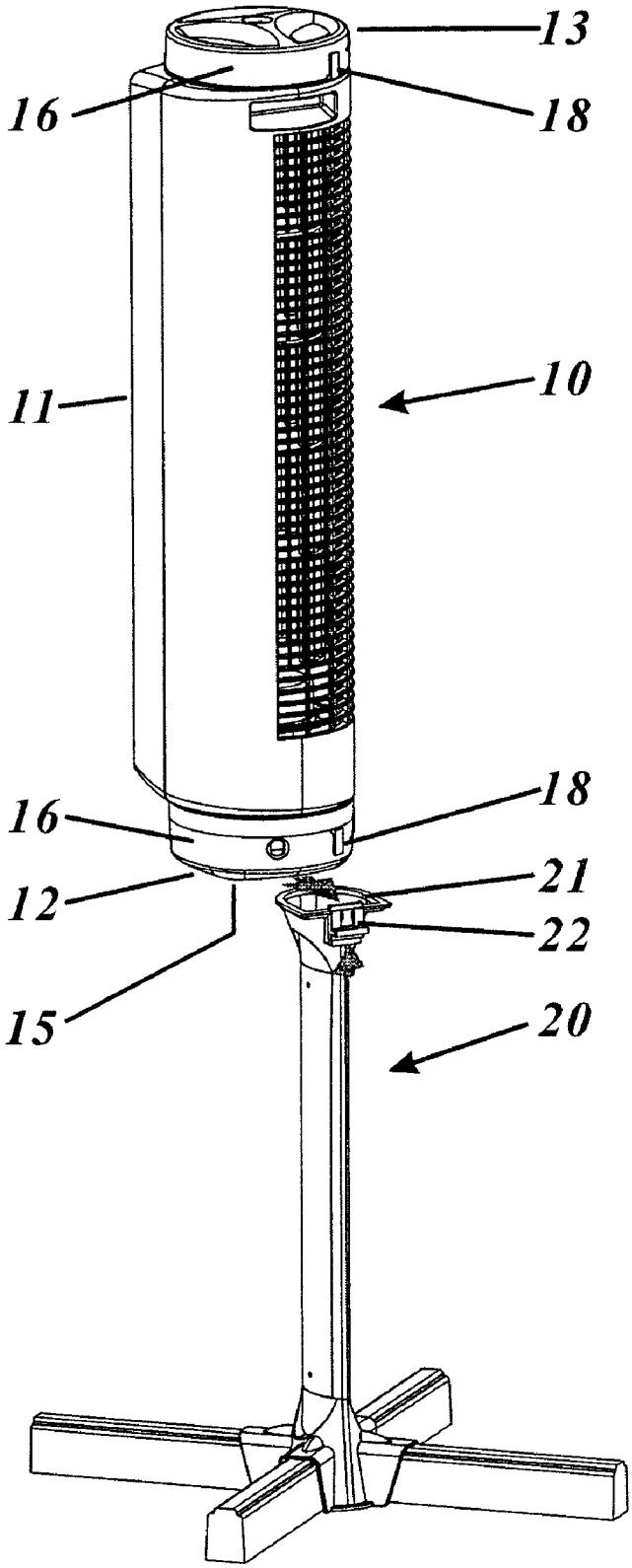
FIG. 2 is an exploded, rear perspective view of the FIG. 1 fan assembly.
Figure 3:
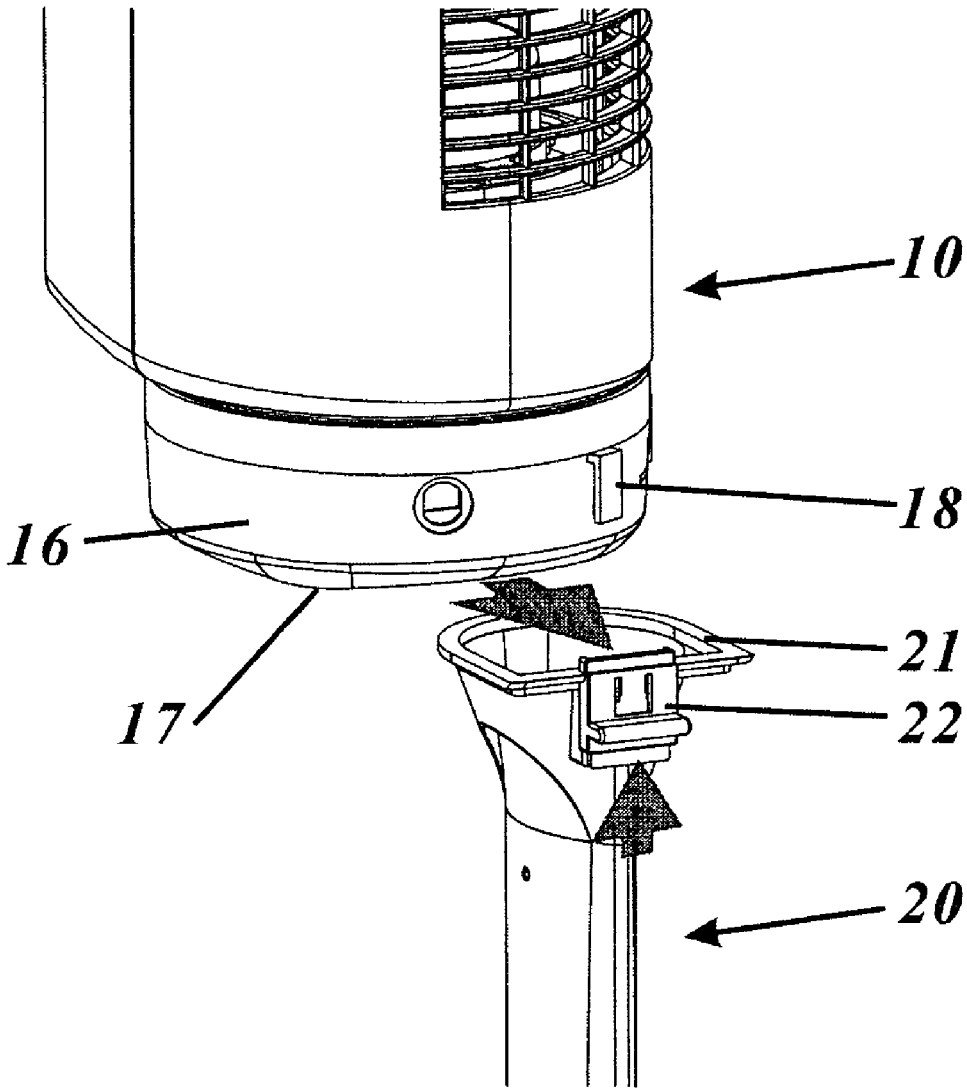
FIG. 3 is an enlarged view of FIG. 2.

In operation, a user may choose a first or upright operational configuration by attaching the fan body 10 to the first support member 20 via the first receiving member 17 and a first attaching member 21, as illustrated in FIGS. 2 and 3. In addition to the first attaching member 21, the first support member 20 preferably includes a locking clip 22, which may be spring loaded. The fan body 10 is securely attached to the first support member 20 by inserting the first attaching member 21 into the first receiving member 17, and securing the position using the locking clip to prevent the first attaching member 21 from slipping out of the first receiving member 17.

In this first or upright operational configuration, the substantially tubular portion 11 of the fan housing rotates circumferentially about the fan drum (not shown), and oscillates back and forth to generate a transverse airflow moving in radial directions away from a rotation axis defined by the rotations of the fan drum and the tubular portion 11. The first support member 20 may be detached from the fan body 10 for easy storage or in preparation of operating the fan assembly in a second or horizontal configuration.

Figure 4:
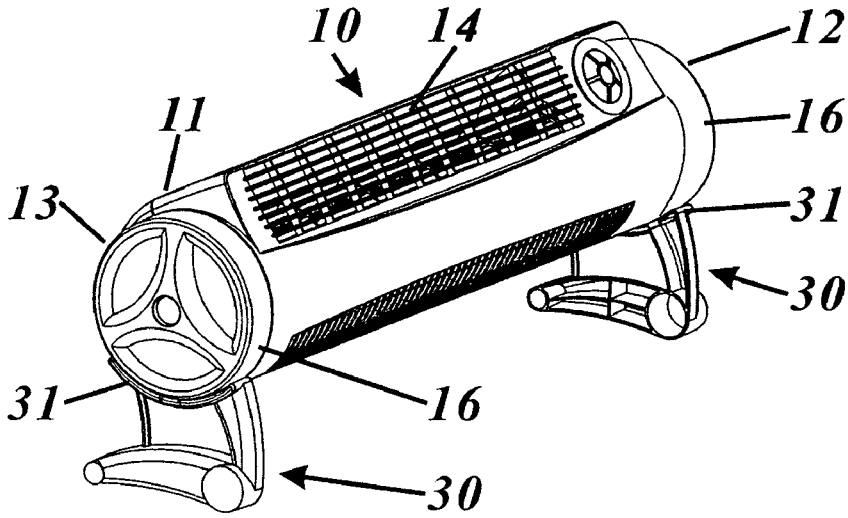
FIG. 4 is a top, front perspective view of the FIG. 1 fan assembly in a second operational configuration.
Figure 5:
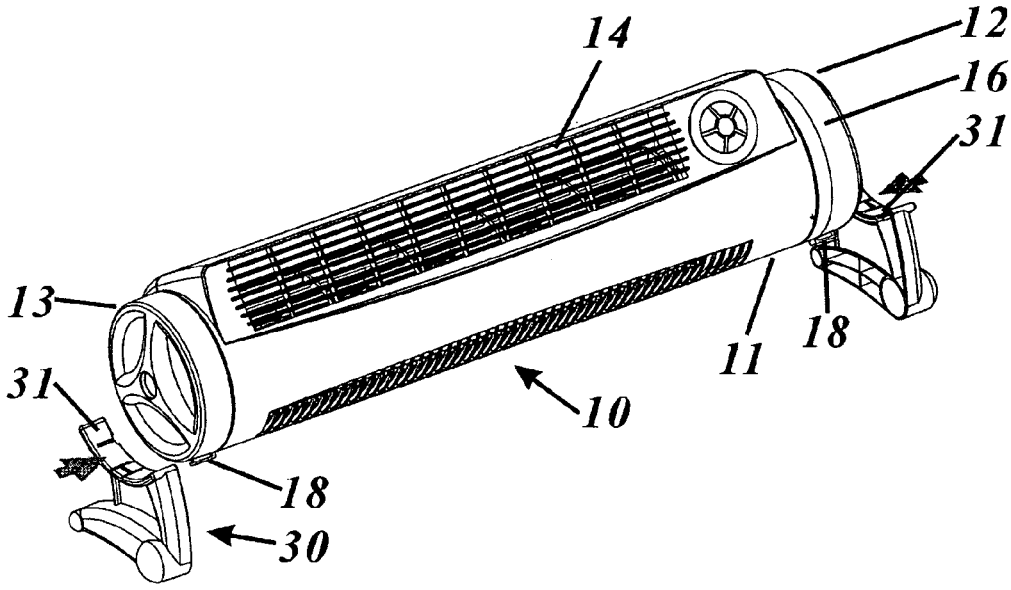
FIG. 5 is an exploded, front perspective view of the FIG. 4 fan assembly.

Turning now to FIGS. 4 and 5, the second or horizontal operational configuration is formed by attaching the fan body 10 to the second support member 30 via the second receiving member 18 and a second attaching member 31. The fan body 10 is securely attached to the second support member 30 by inserting the second attaching member 31 into the second receiving member 18, as shown in FIG. 5, such that the second receiving member 18 securely clips into the second attaching member 31. Note that the relative male-to-female roles of the receiving members 17 and 18 and their corresponding attaching members 21 and 31 may be reversed without deviating from the principles of the present invention.

In the second configuration, therefore, the substantially tubular portion 11 of the fan housing rotates circumferentially about the fan drum (not shown), and oscillates back and forth to generate a vertically oscillating airflow moving in radial directions away from the rotation axis of the fan drum and the tubular portion 11. The second support member 30 may be detached from the fan body 10 for easy storage or in preparation of operating the fan assembly in the first configuration.

Figure 6:
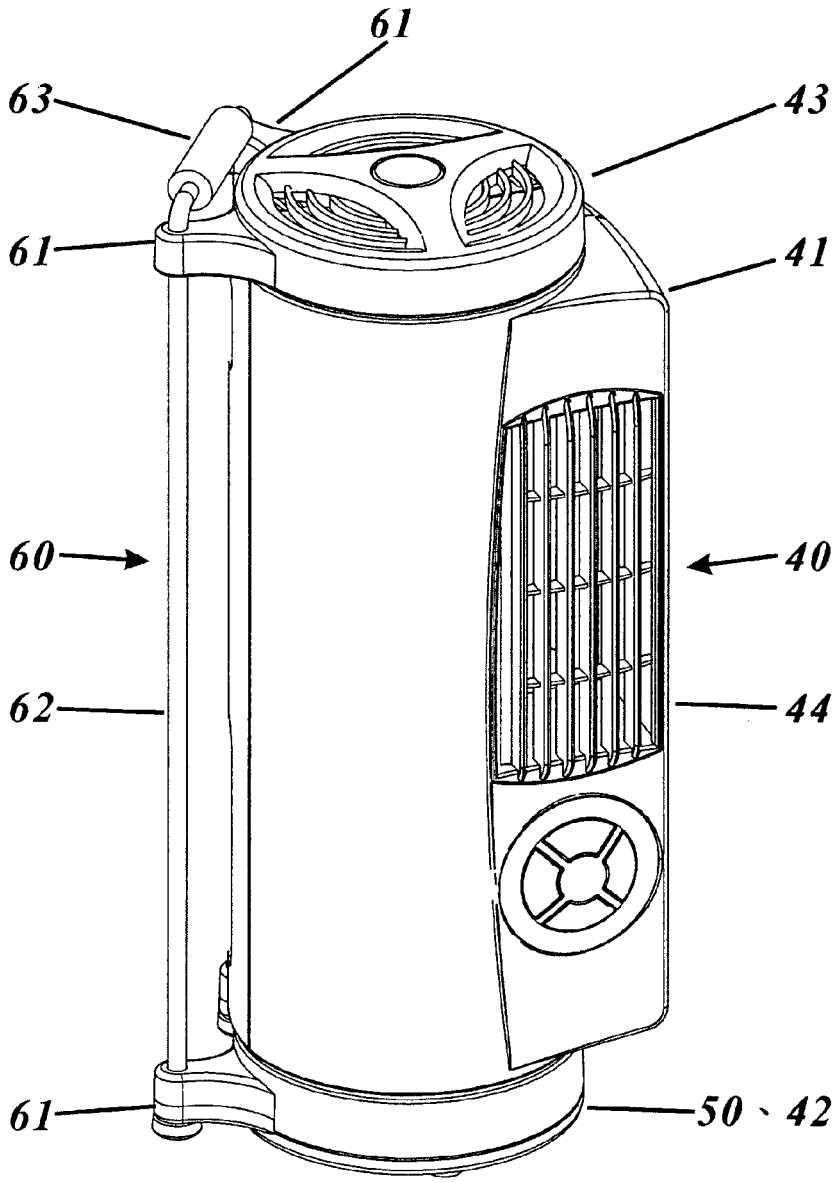
FIG. 6 is a top, front perspective view of another embodiment of a fan assembly in a first operational configuration in accordance with the present invention.
Figure 7:
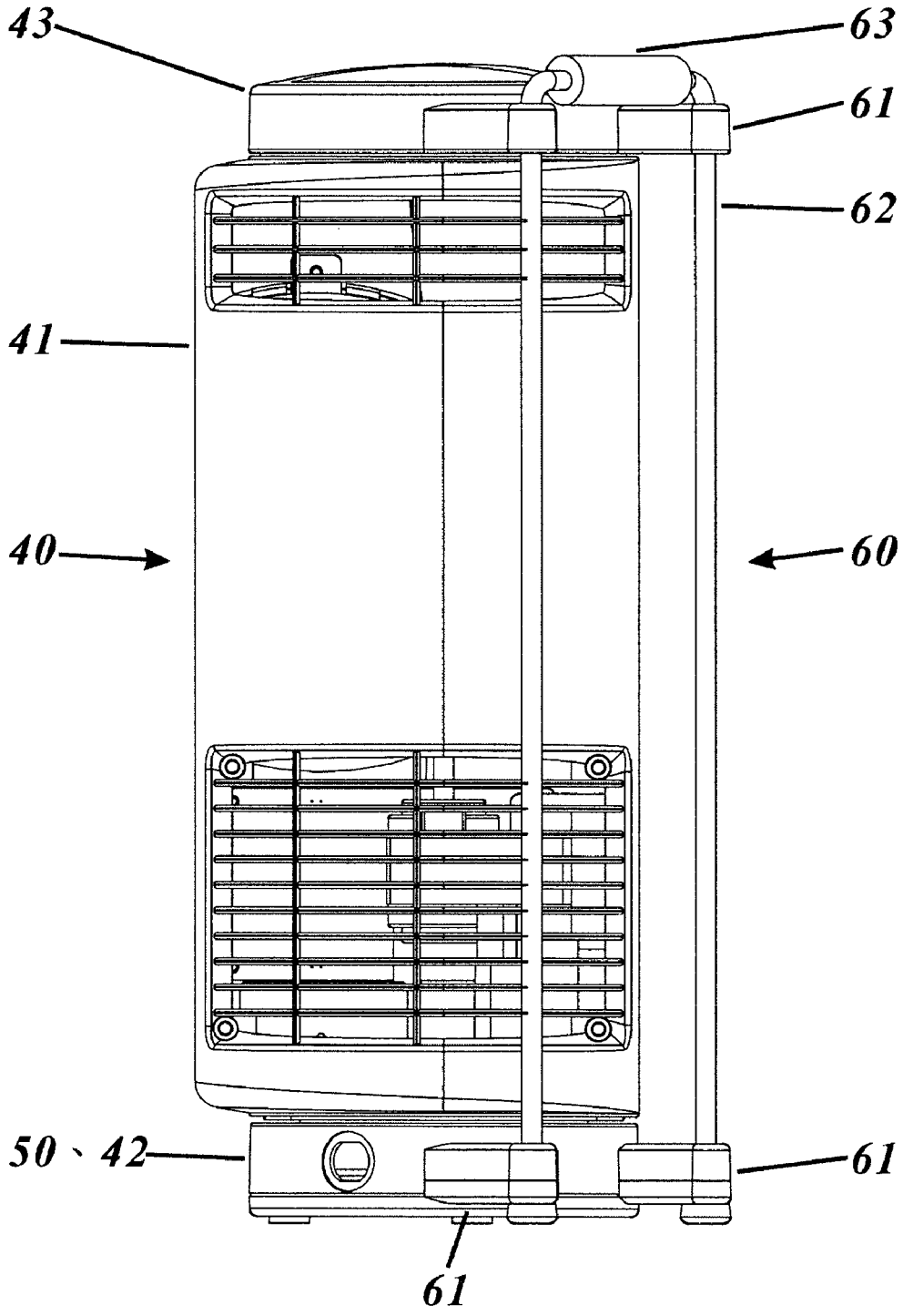
FIG. 7 is a rear elevational view of the FIG. 6 fan assembly.
Figure 8:
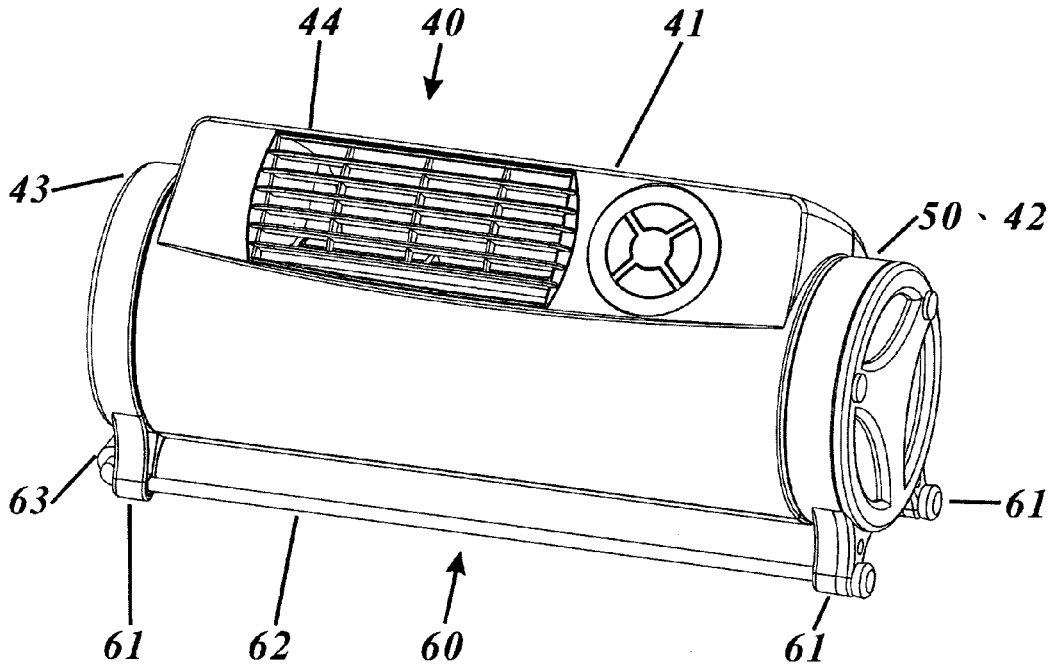
FIG. 8 is a top, front perspective view of the FIG. 6 fan assembly in a second operational configuration.

Referring now to FIGS. 6–8, another embodiment of a fan assembly in accordance with the present invention includes a fan body 40, a first support member 50, and a second support member 60.

Similar to the first embodiment, the fan body 40 comprises a fan (not shown)—preferably an elongated spinning drum having a plurality of fan blades—situated inside a substantially cylindrical fan housing, which includes a substantially tubular portion 41, a first end cap member 42, a second end cap member 43, and at least one ventilation opening 44, preferably a grille. The substantially tubular portion 41 is preferably rotatable with respect to the end cap members 42 and 43.

In this embodiment, however, the first supporting member 50 and the first end cap member 42 are one and the same. That is, the fan body 40 rests on the first end cap member 42 when the fan assembly operates in a first or vertical configuration. The fan assembly generates a transversely oscillating airflow similar to the fan assembly of the first embodiment described above.

To use the fan assembly in a second or horizontal configuration, one simply tilts the fan assembly approximately 90 degrees such that the fan assembly rests on the second support member 60, which is preferably attached fixedly to the fan body 40. As illustrated, the second support member 60 preferably comprises four legs 61 connected by a U-shaped tube 62. The U-shaped tube 62 adds structural integrity to the fan assembly and is an optional feature. The second support member 60 may additionally include a handle bar 63 for easy handling. In this second configuration, the fan assembly generates a vertically oscillating airflow similar to the fan assembly of the first embodiment described above.

The uniqueness of the embodiment illustrated in FIGS. 6–8 is that the fan assembly is a whole unit, with both of the supporting members 50 and 60 already attached. As such, this embodiment is most suitably used as a personal unit on top of a desk, for example.

Figure 9:
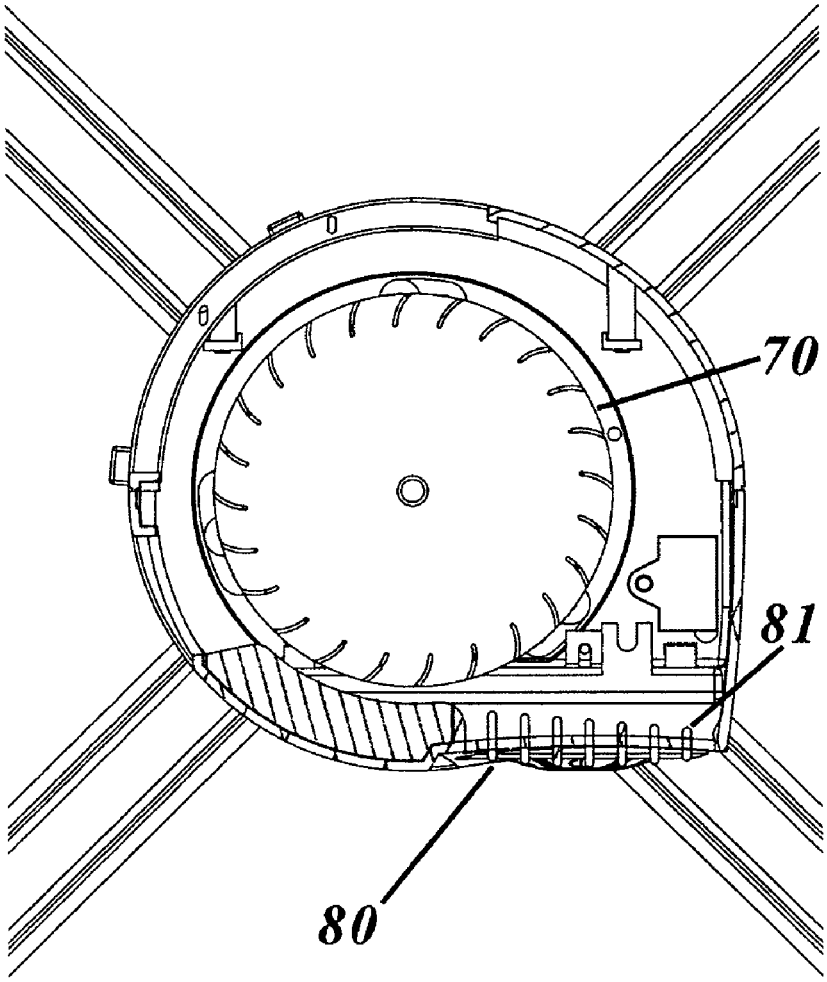
FIG. 9 is a cross-sectional view of FIG. 1, taken along section lines A—A.

As shown in FIG. 9, a fan body similar to fan bodies 10 and 40 may increase the air outflow by employing a grille member with varied thickness in a circumferential direction about the fan drum. It is believed that pockets of air currents that form small eddies or vortexes inside a traditional fan unit having a fan grille of uniform thickness are reduced by using a grille member with varied thickness. With the absence or a reduction of conflicting air currents inside the fan housing, the air outflow from a fan assembly will increase, and the fan assembly may be used more efficiently.

Referring to FIG. 9, the thickness of a grille member 80 in accordance with the present invention decreases in a circumferential direction about the fan drum 70 opposite to the rotation of the fan drum 70, creating a tapered portion 81 for the grille member 80.

Although the invention herein has been described with references to particular embodiments, it is to be understood that the embodiments are merely illustrative of, and are not intended as a limitation upon, the principles and application of the present invention. It is therefore to be understood that various modifications may be made to the above mentioned embodiments and that other arrangements may be devised without departing from the spirit and scope of the present invention.

For example, the fan bodies 10 and 40 as described above may comprise a fan housing with a stationary tubular portion 11 or 41, respectively, resulting in a constant and stationary airflow.

I claim:

1. A fan assembly, comprising: a fan inside a housing having a first surface and a second surface; a first support element; and a second support element, wherein the first surface is substantially perpendicular to the second surface, and the housing is operationally supported by one member of the group consisting of: the first support element at the first surface; and the second support element at the second surface;

wherein the first support element is detachably attachable to the first surface, and the second support element is detachably attachable to the second surface;

wherein the housing comprises a substantially tubular portion having two opposite ends each covered by an end cap member having a substantially circular top surface and a perimeter surface circumferentially joined with the top surface, the perimeter surface being substantially perpendicular to the top surface;

wherein the first surface is the top surface of one of the two end cap members and the second surface is the perimeter surface of each of the two end cap members, and wherein the second support element comprises two legs each individually attachable to the perimeter surface of one of the two end cap members.

2. The fan assembly of claim 1, wherein the fan is an elongated spinning drum having a plurality of fan blades and an axis of rotation, and the tubular portion is rotatably coupled to the end cap members.

3. The fan assembly of claim 2, wherein the tubular portion comprises at least one grille member having a substantially uniform thickness along the axis of rotation extending substantially radially toward the axis of rotation but different thicknesses circumferentially about the axis of rotation.

4. The fan assembly of claim 3, wherein the grille member has a tapered thickness in a circumferential direction about the axis of rotation opposite to the rotation of the fan.

5. The fan assembly of claim 4, wherein the grille member comprises two tapered portions, which are tapered in opposite circumferential directions about the axis of rotation.

6. A method for enhancing a fan unit's operational versatility, comprising: providing a first support member attachable to a first surface of the fan unit; and providing a second support member attachable to a second surface of the fan unit, the second surface being substantially perpendicular to the first surface, wherein the fan unit comprises a fan inside a housing, and wherein a first operational configuration results when the first support member is attached to the first surface, and a second operational configuration results when the second support member is attached to the second surface, the first operational configuration being interchangeable with the second operational configuration;

wherein the housing comprises a substantially tubular portion having two opposite ends each covered by an end cap member having a substantially circular top surface and a perimeter surface circumferentially joined with the top surface, the perimeter surface being substantially perpendicular to the top surface;

wherein the first surface is the top surface of one of the two end cap members and the second surface is the perimeter surface of each of the two end cap members, and wherein the second support element comprises two legs each individually attachable to the perimeter surface of one of the two end cap members.

7. The method of claim 6, wherein the fan is an elongated spinning drum having a plurality of fan blades and an axis of rotation, and the tubular portion is rotatably coupled to the end cap members.

8. The method of claim 7, wherein the tubular portion comprises at least one grille member having a substantially uniform thickness along the axis of rotation extending substantially radially toward the axis of rotation but different thicknesses circumferentially about the axis of rotation.

9. The fan assembly of claim 8, wherein the grille member has a tapered thickness in a circumferential direction about the axis of rotation opposite to the rotation of the fan.

* * * * *